US008083531B1

(12) United States Patent
Ourasanah et al.

(10) Patent No.: US 8,083,531 B1
(45) Date of Patent: Dec. 27, 2011

(54) POWER CONNECTOR

(76) Inventors: Manour Ourasanah, San Francisco, CA (US); Christopher Hawker, Columbus, OH (US)

( * ) Notice: Subject to any disclaimer, the term of this patent is extended or adjusted under 35 U.S.C. 154(b) by 0 days.

(21) Appl. No.: 12/650,511

(22) Filed: Dec. 30, 2009

Related U.S. Application Data

(60) Provisional application No. 61/141,719, filed on Dec. 31, 2008.

(51) Int. Cl.
*H01R 13/62* (2006.01)

(52) U.S. Cl. ..... 439/159

(58) Field of Classification Search ..... 439/157, 439/159, 160, 152, 155; 174/66
See application file for complete search history.

(56) References Cited

U.S. PATENT DOCUMENTS

| | | | | |
|---|---|---|---|---|
| 2,134,345 | A | 10/1938 | Sheeran | |
| 2,551,533 | A * | 5/1951 | Gernheuser | 439/160 |
| 2,551,553 | A | 5/1951 | Gernheuser | |
| 2,977,564 | A * | 3/1961 | Civitelli et al. | 439/160 |
| 3,742,414 | A | 6/1973 | Gittin | |
| 3,936,123 | A * | 2/1976 | Gossett et al. | 439/155 |
| 4,042,292 | A | 8/1977 | Chensky | |
| 4,045,106 | A | 8/1977 | Borg | |
| 4,114,969 | A | 9/1978 | Borg | |
| 4,314,735 | A * | 2/1982 | Fullenkamp et al. | 439/152 |
| 5,447,443 | A | 9/1995 | Ramah | |
| 5,752,850 | A | 5/1998 | Ziegler | |
| 6,540,533 | B1 | 4/2003 | Schreiber | |
| 6,913,475 | B2 | 7/2005 | Hsu | |
| 7,234,953 | B2 | 6/2007 | Chen | |

OTHER PUBLICATIONS http://www.idsa.org/IDEA_Awards/gallery/2008/award_details.asp?ID=760.
http://www.core77.com/competitions/GreenerGadgets/projects/4530/.

* cited by examiner

*Primary Examiner* — Edwin A. Leon
(74) *Attorney, Agent, or Firm* — Gordin, Vadim

(57) ABSTRACT

A connector group is disclosed including at least a substantially hollow body; an electrically conductive connector disposed on the surface of the body; wherein the connector is capable of receiving and retaining a plug therewithin and is configured to couple that plug to an electrical network; wherein each plug has at least one electrical conductor protruding from a plug face disposed at an end of a flexible electrical conductor; a lever pivotably coupled to the body with the lever being a member having at least a distal end portion, a proximal end portion, and a hinge disposed therebetween.

16 Claims, 20 Drawing Sheets

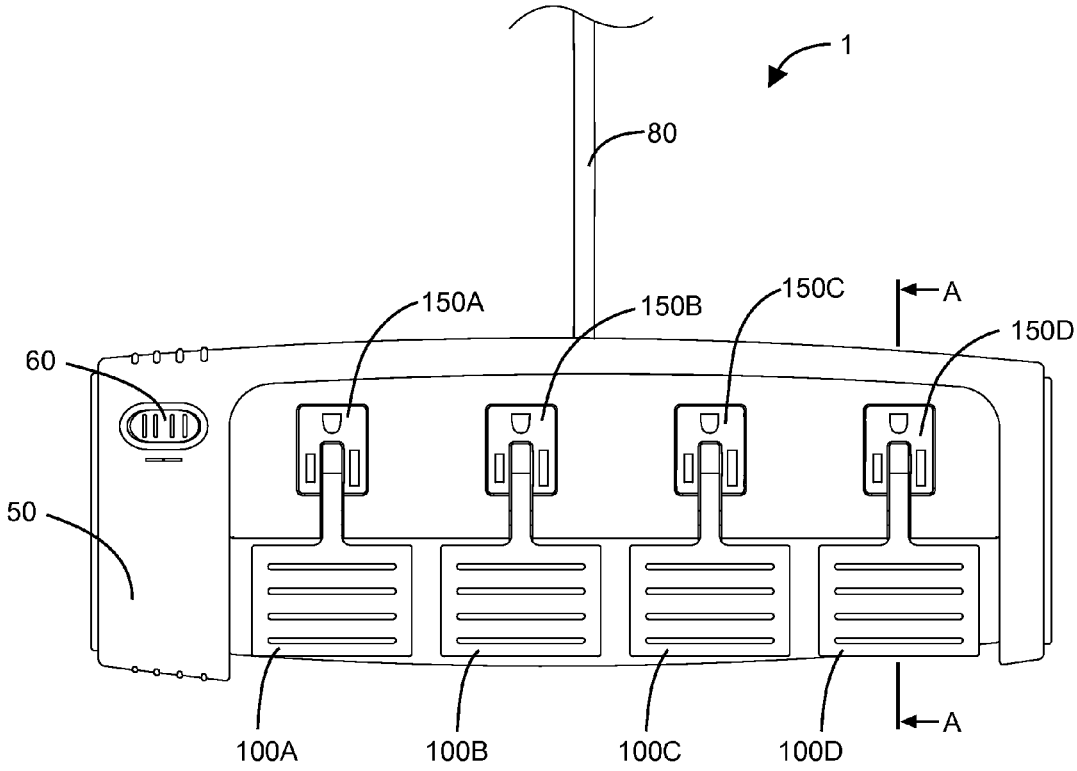
Figure No. 1

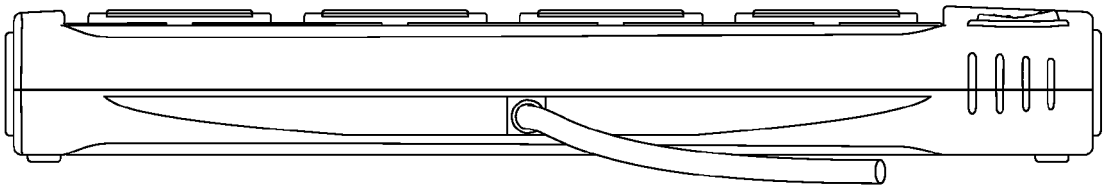
Figure No. 2

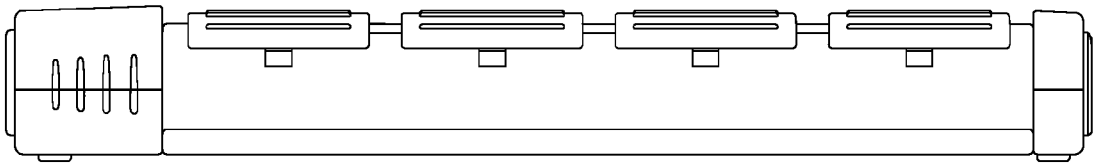
Figure No. 3

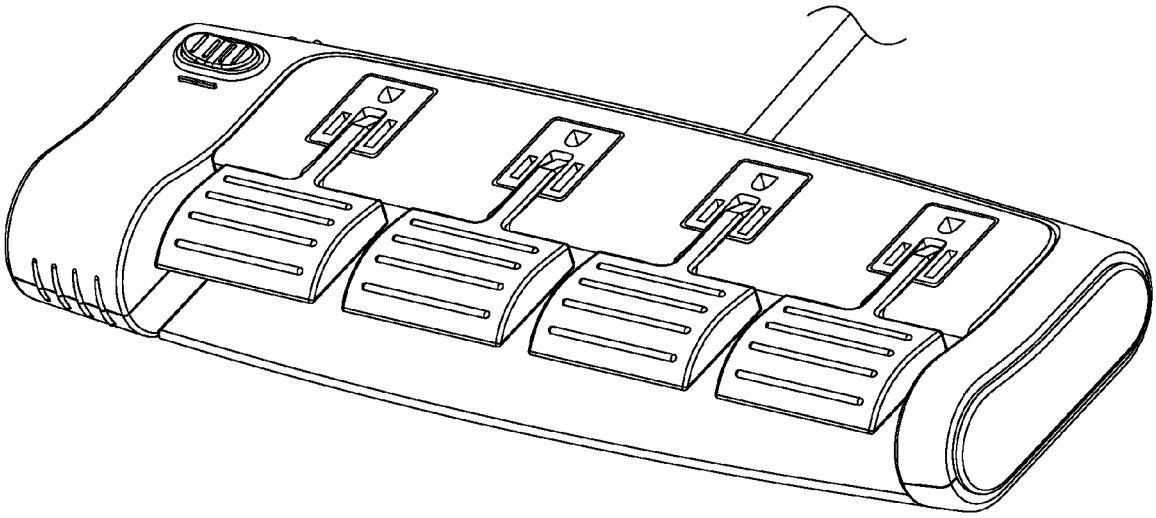
Figure No. 4

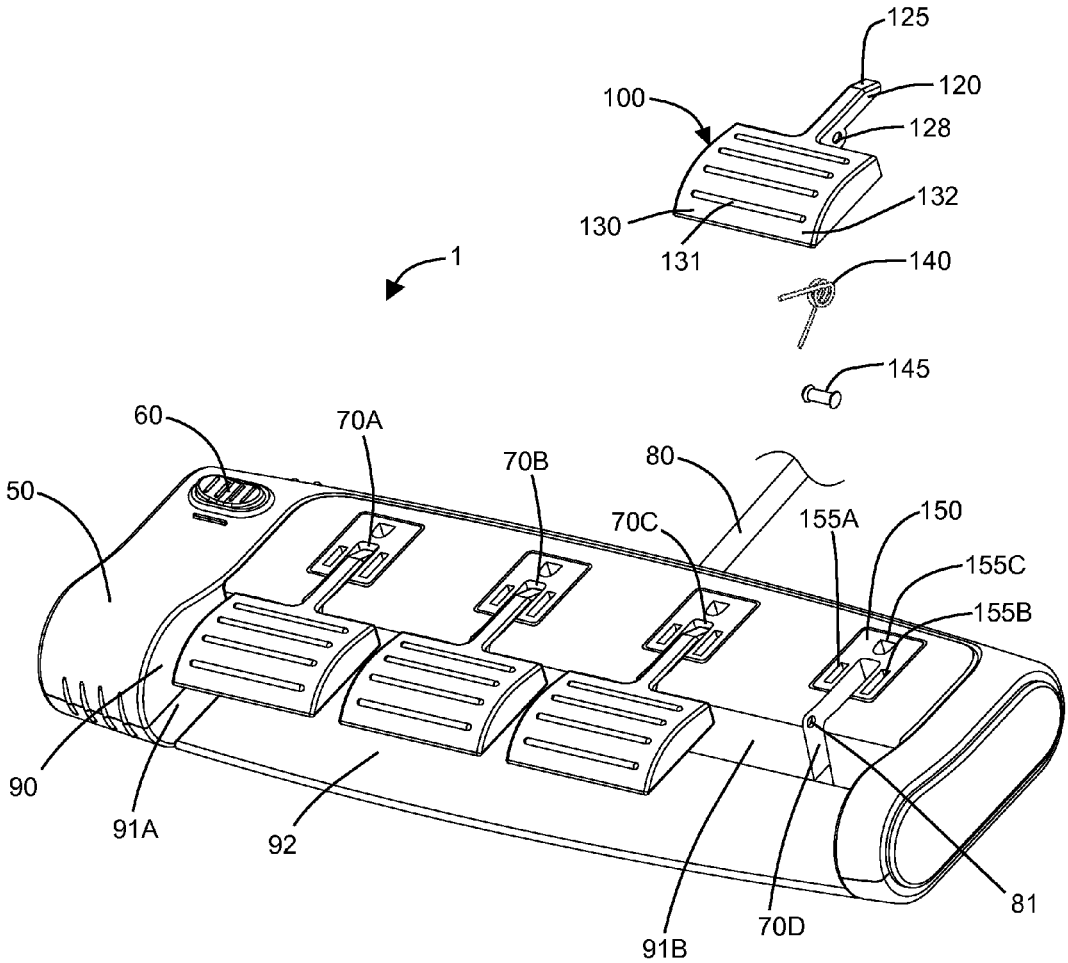
Figure No. 5

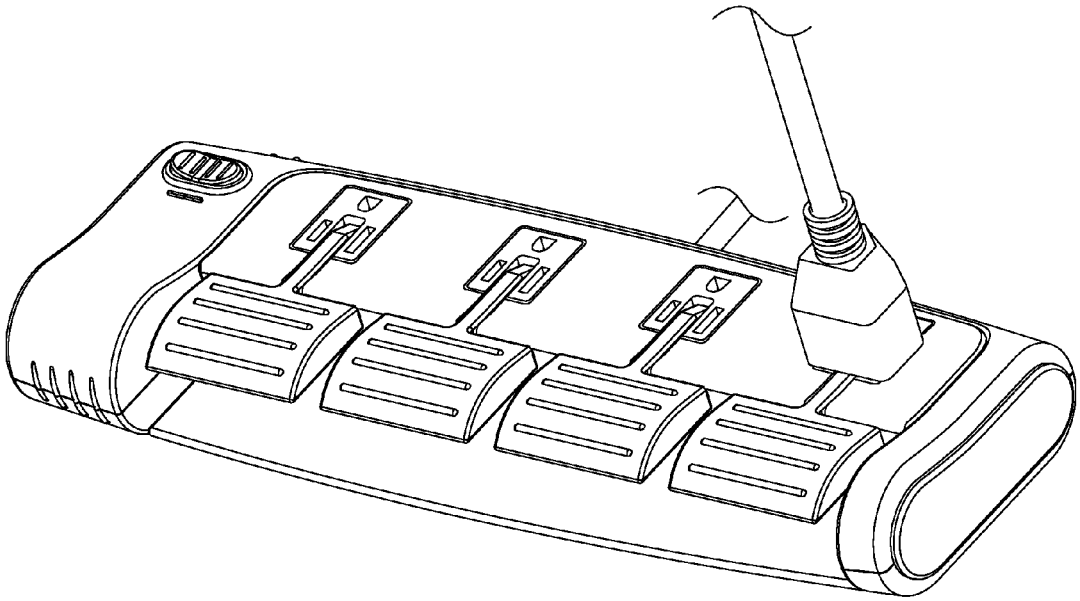
Figure No. 6

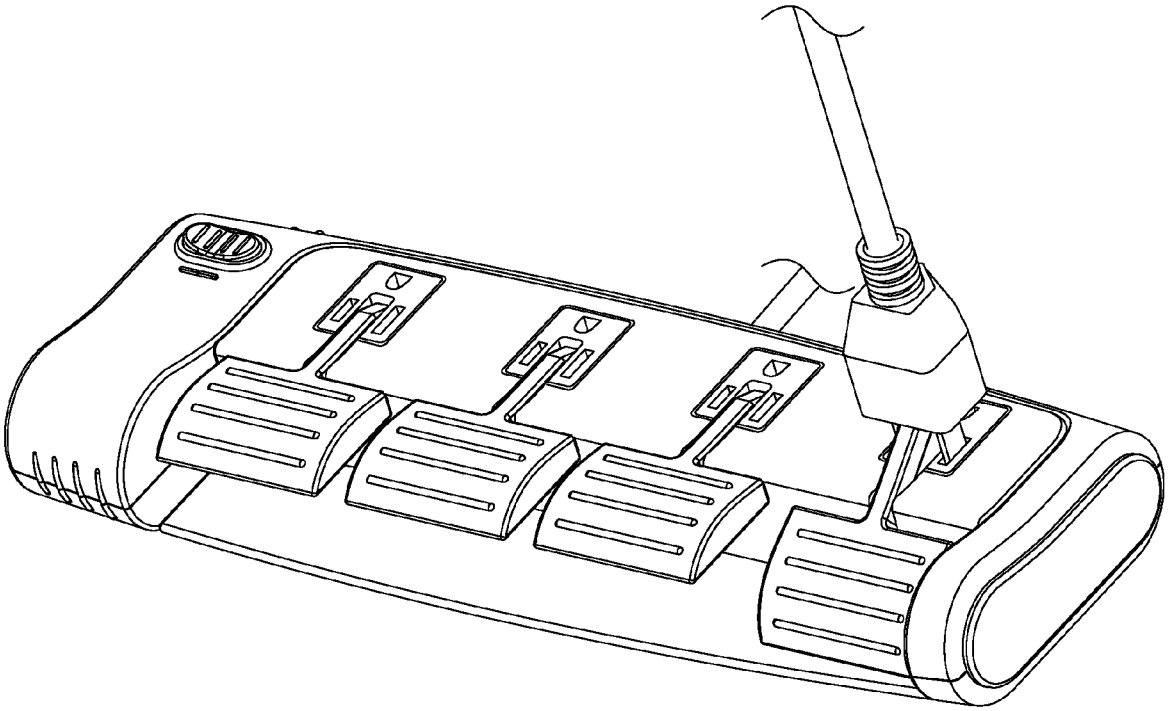
Figure No. 7

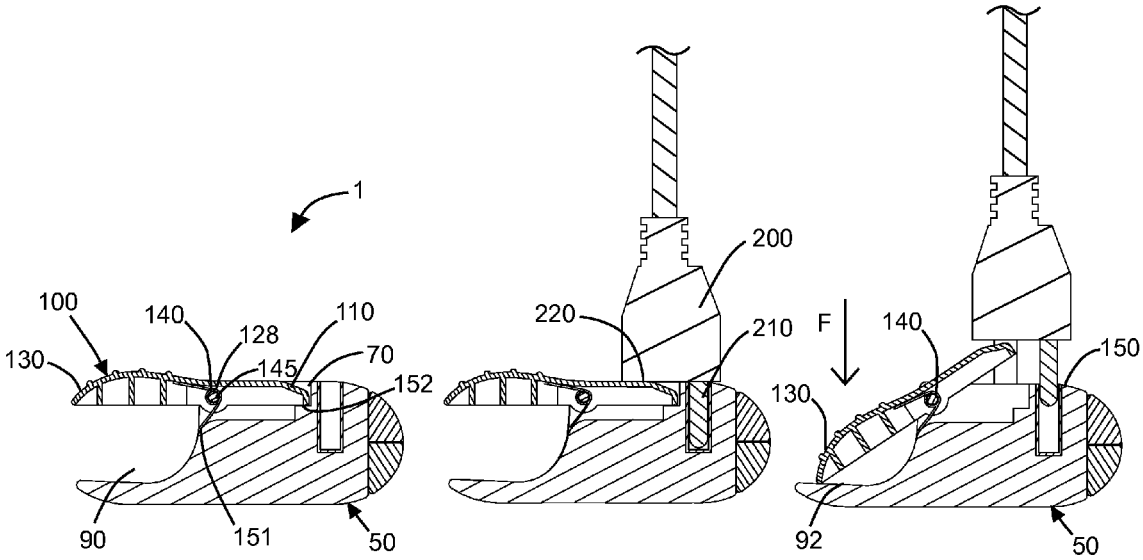
8A 8B 8C
Figure No. 8

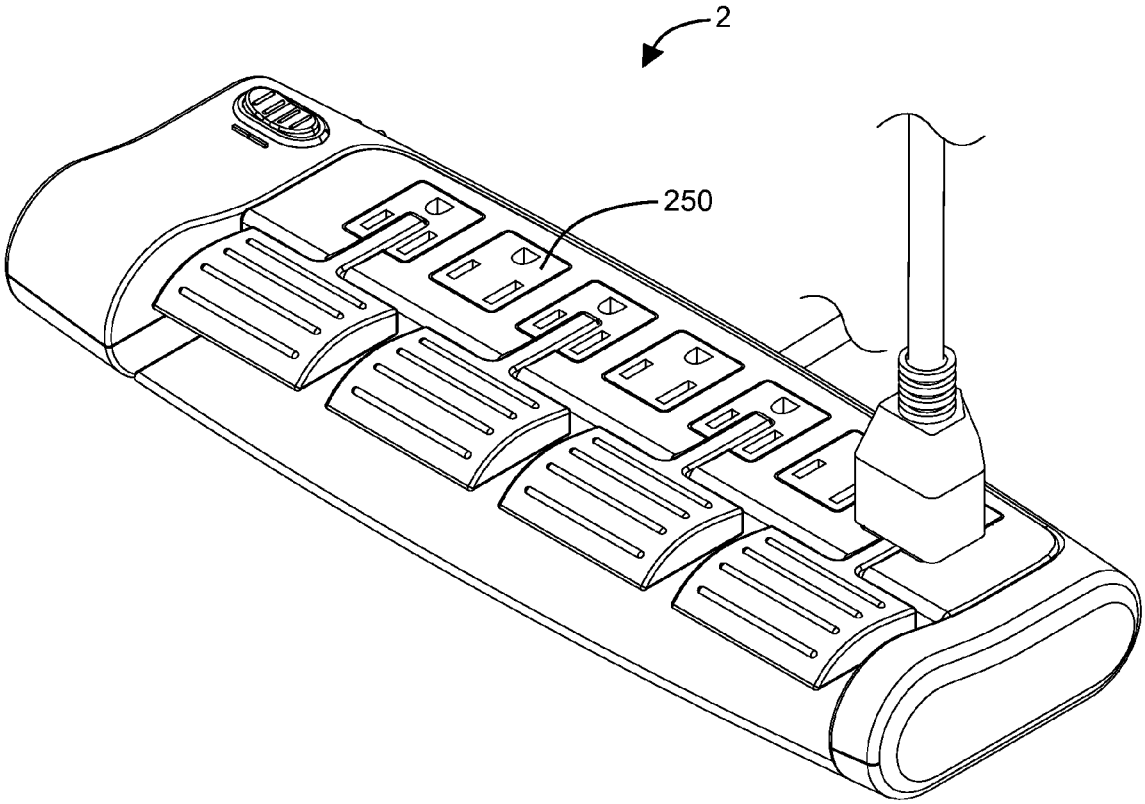
Figure No. 9

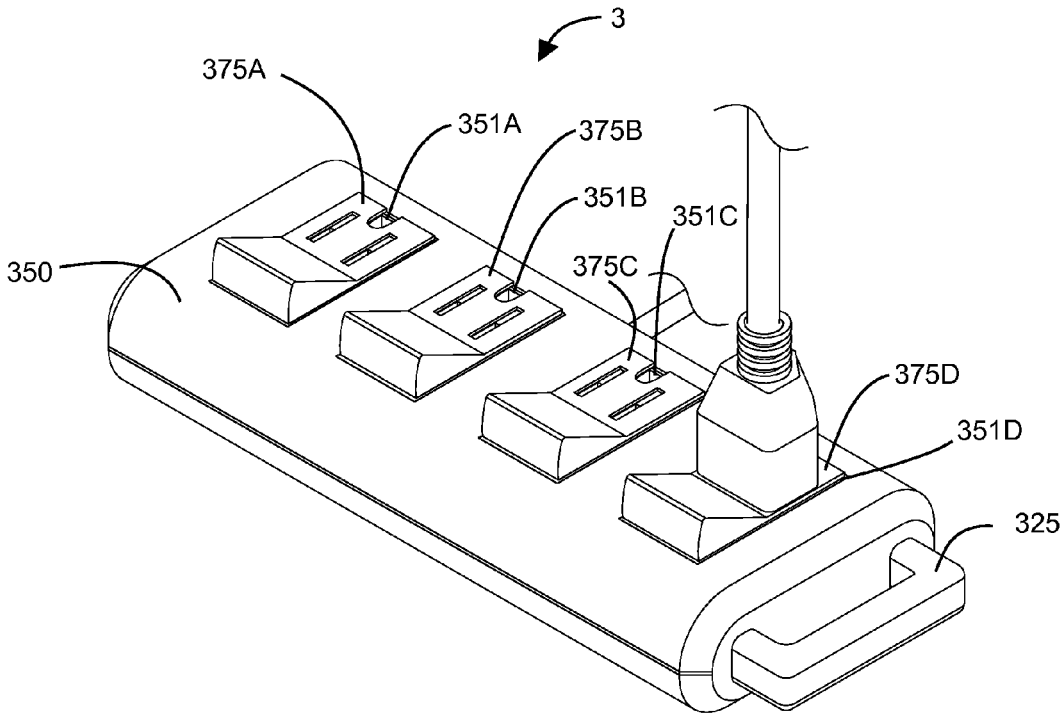
Figure No. 10

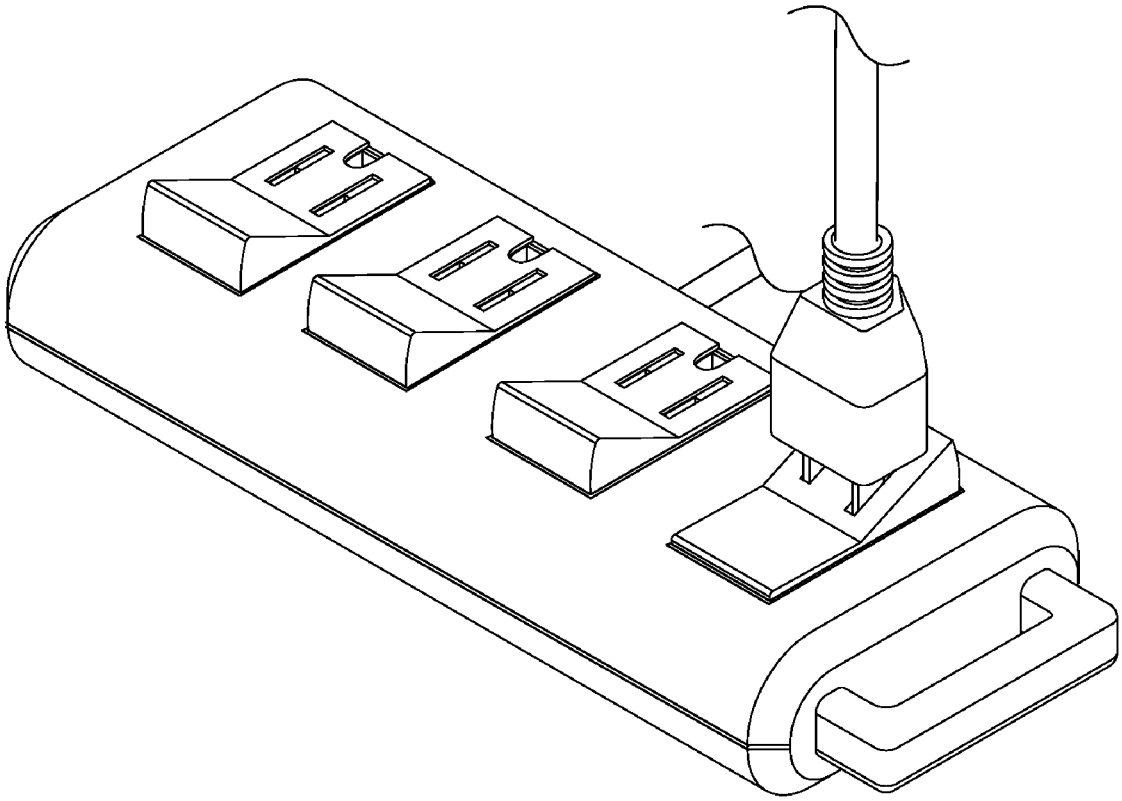
Figure No. 11

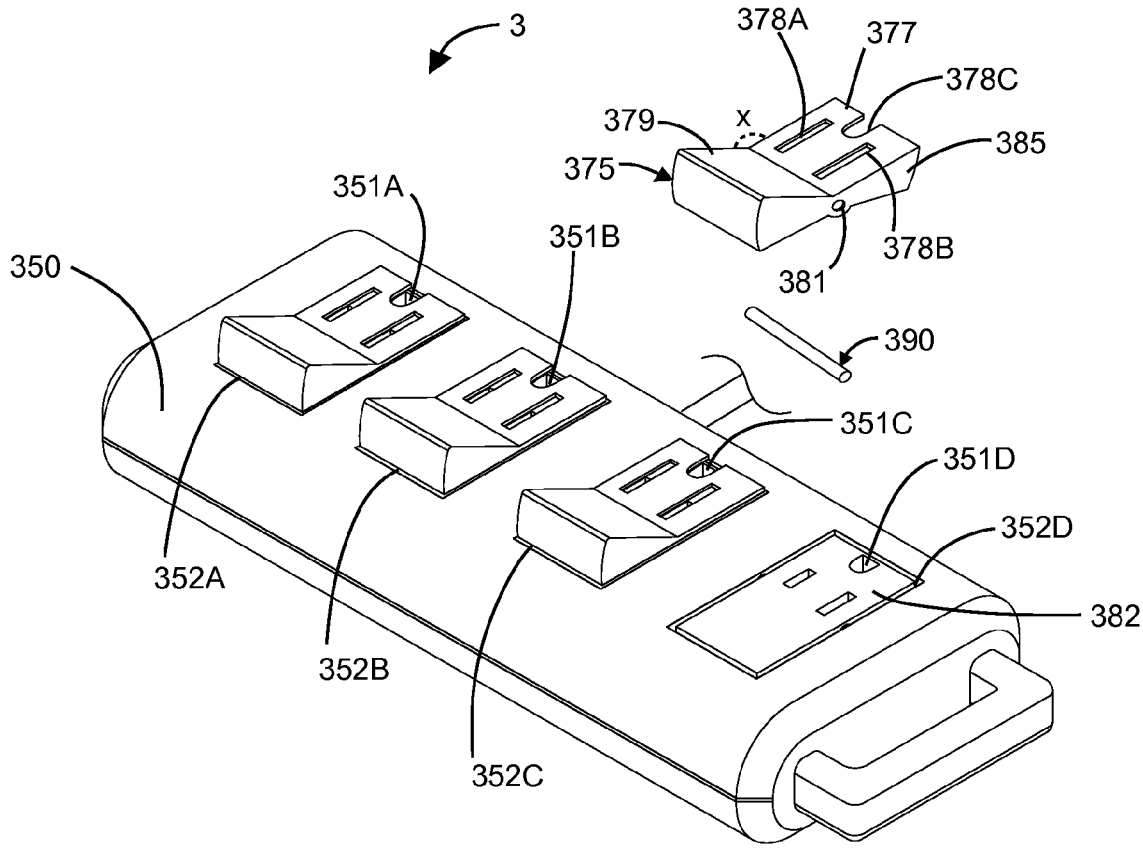
Figure No. 12

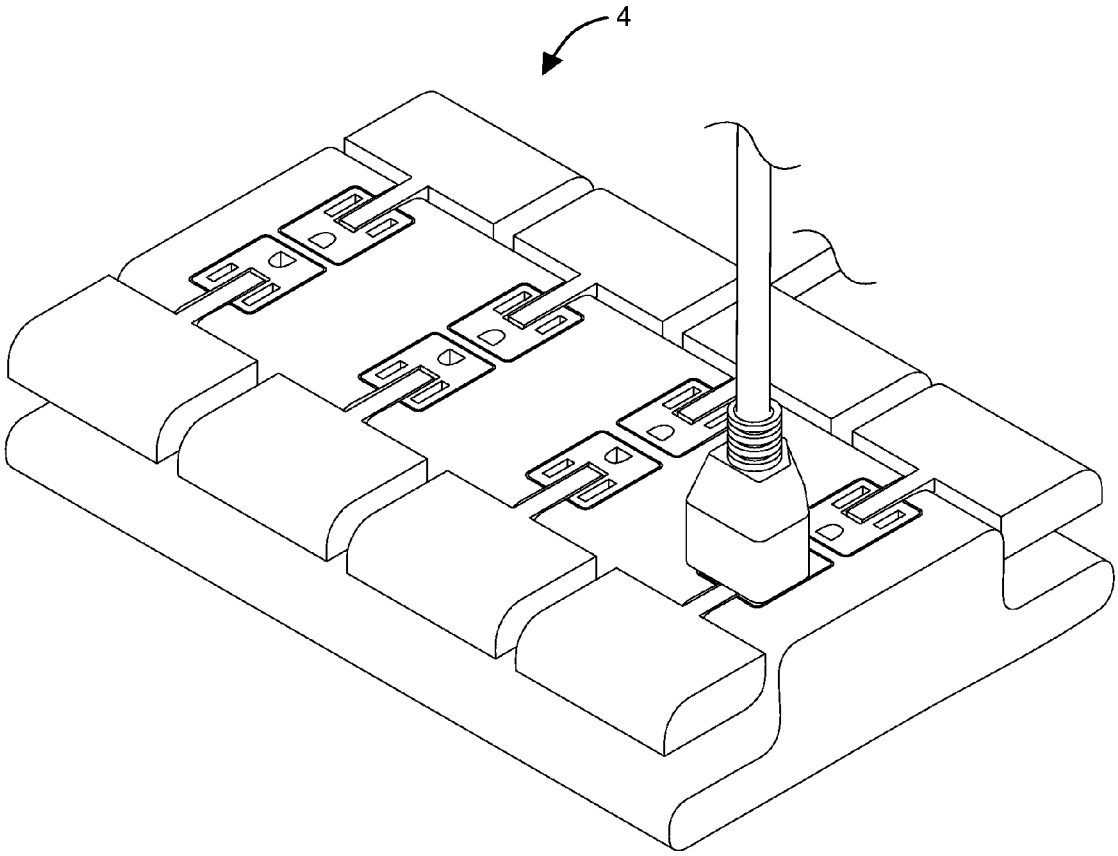
Figure No. 13

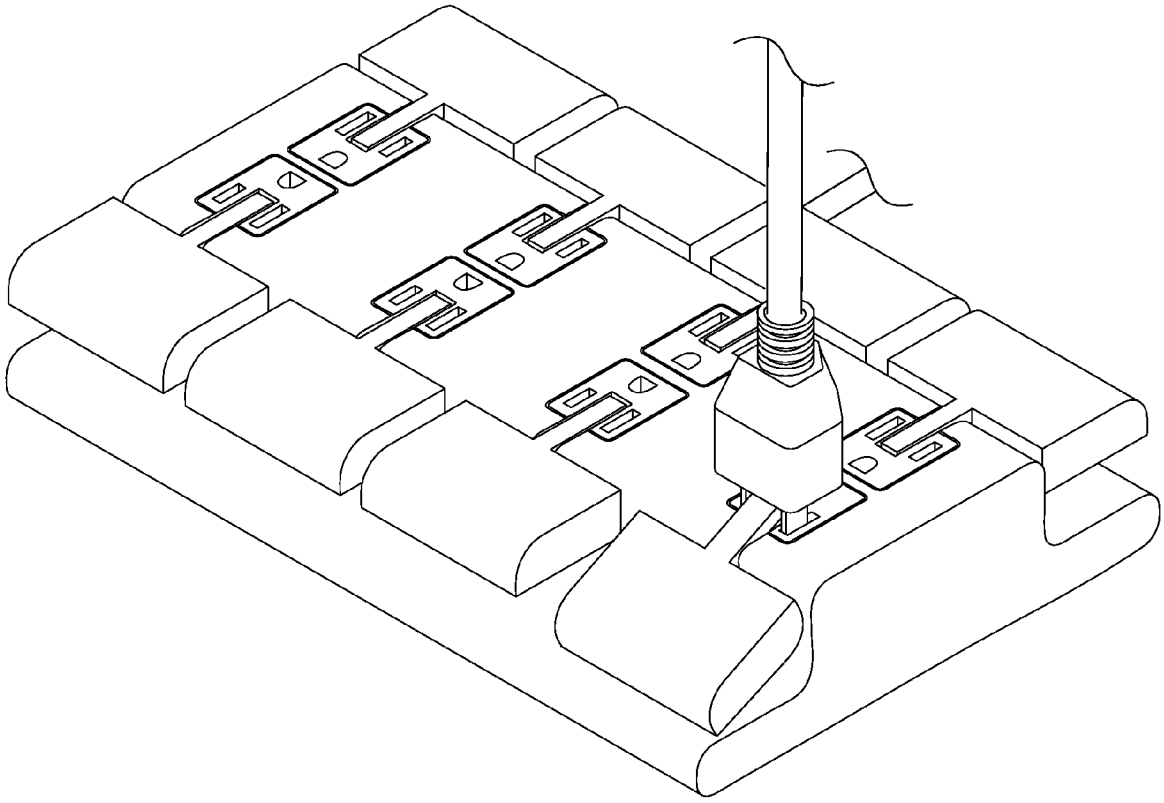
Figure No. 14

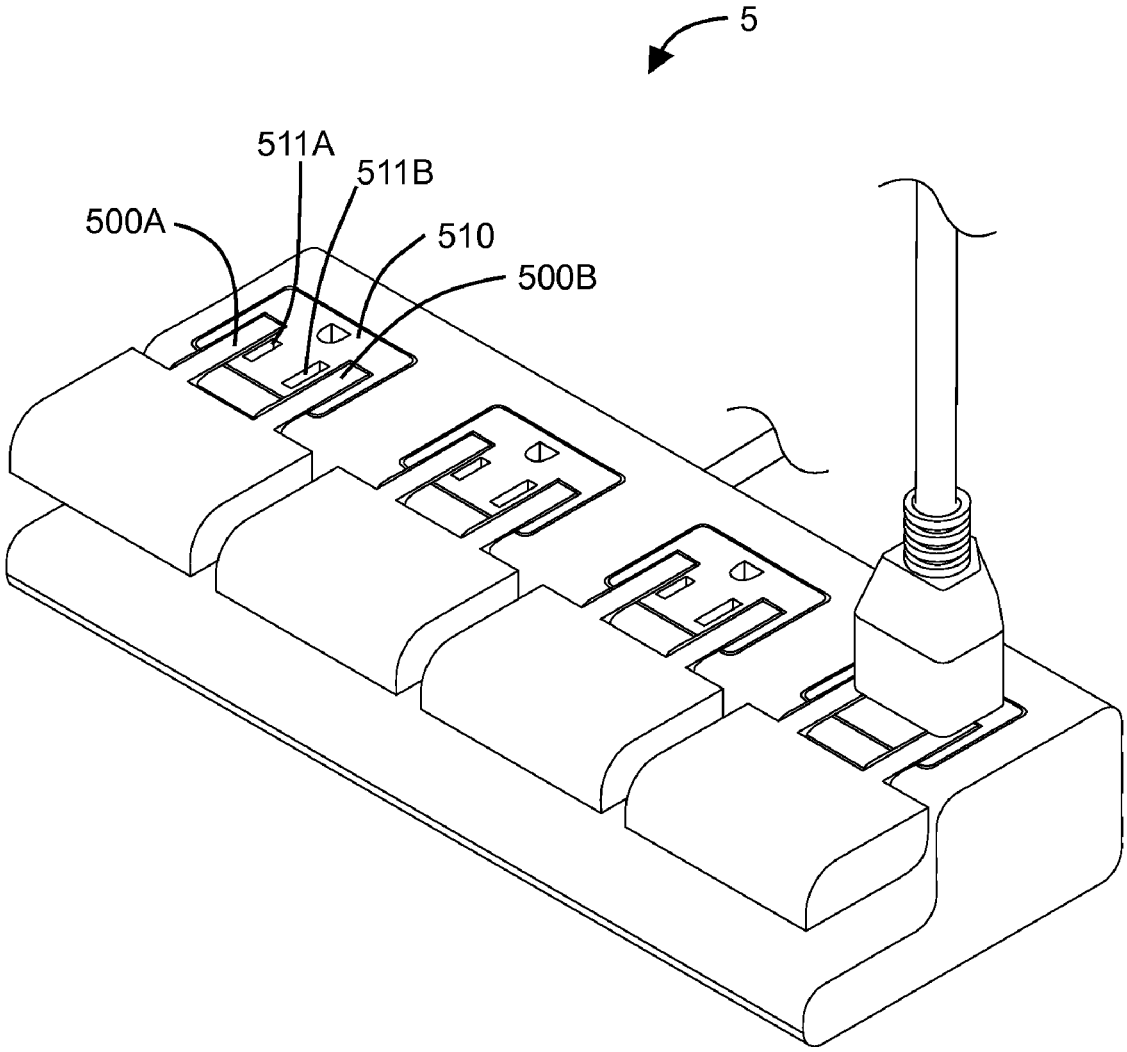
Figure No. 15

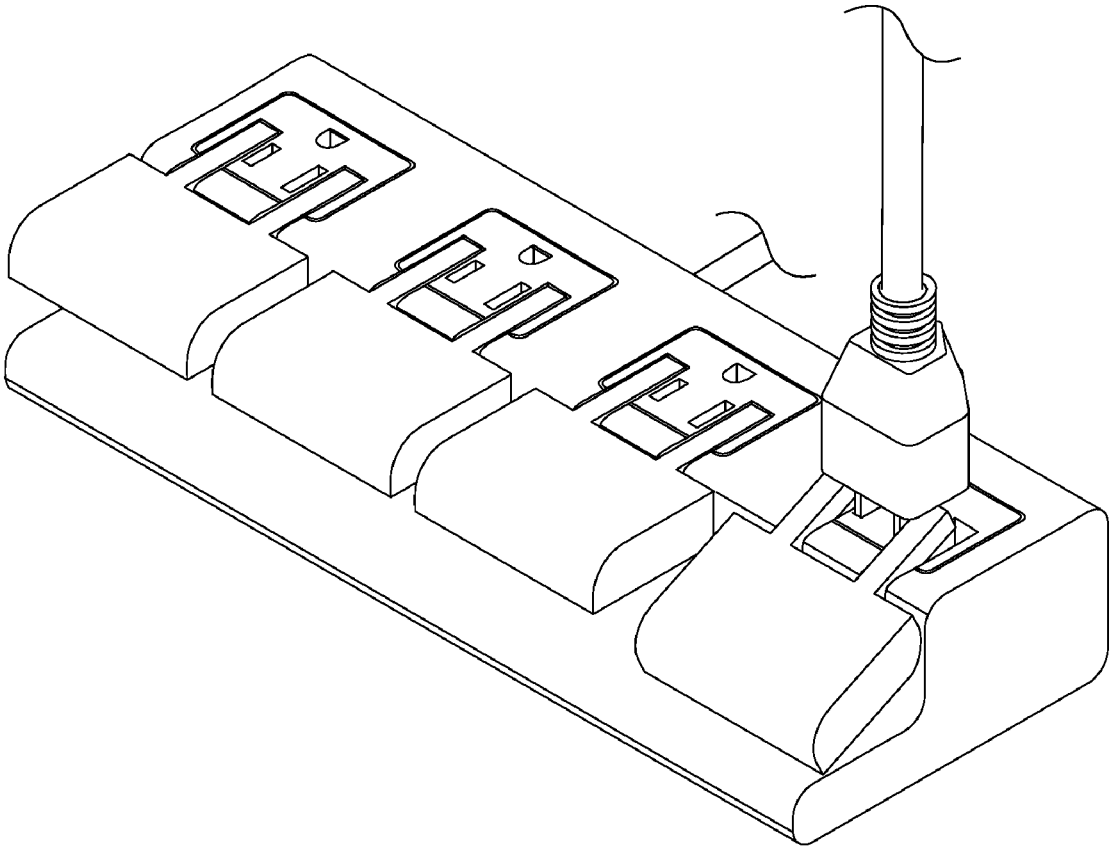
Figure No. 16

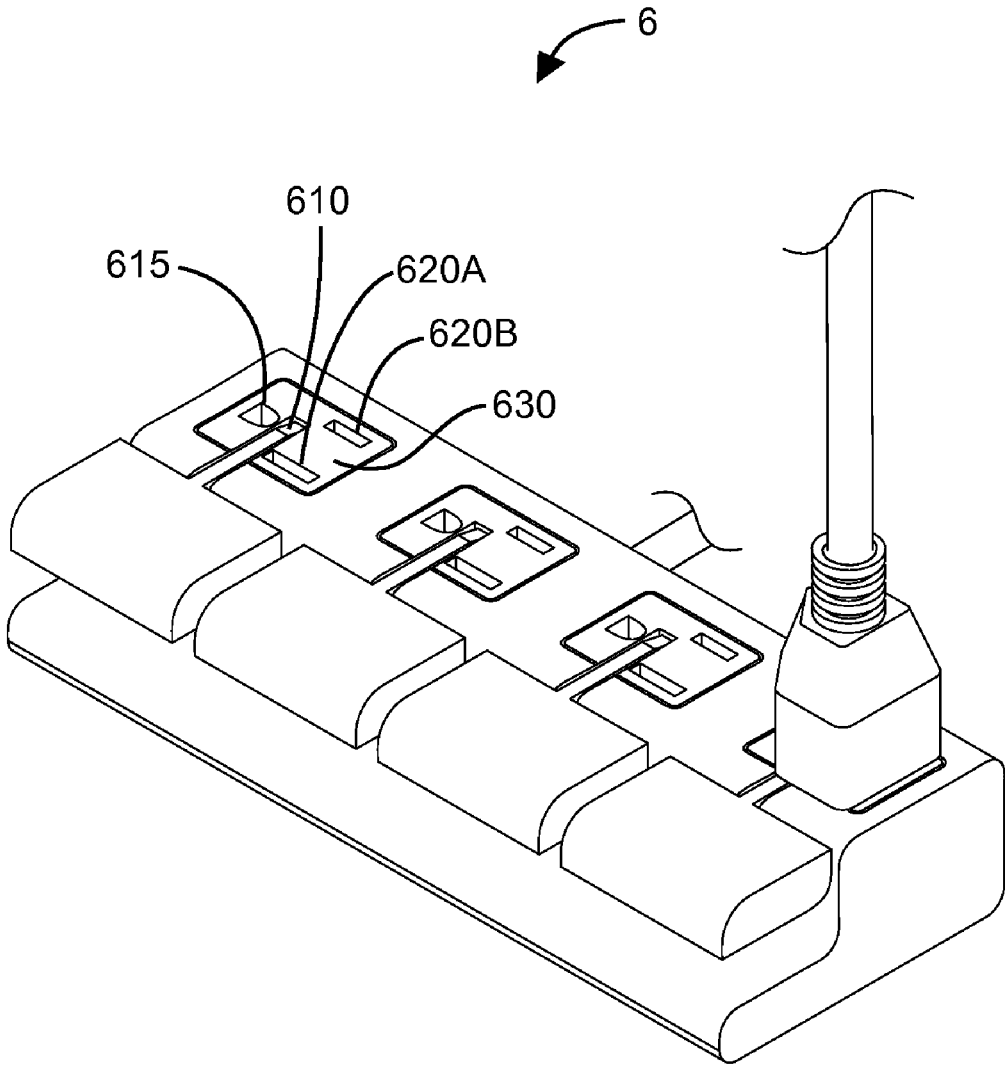
Figure No. 17

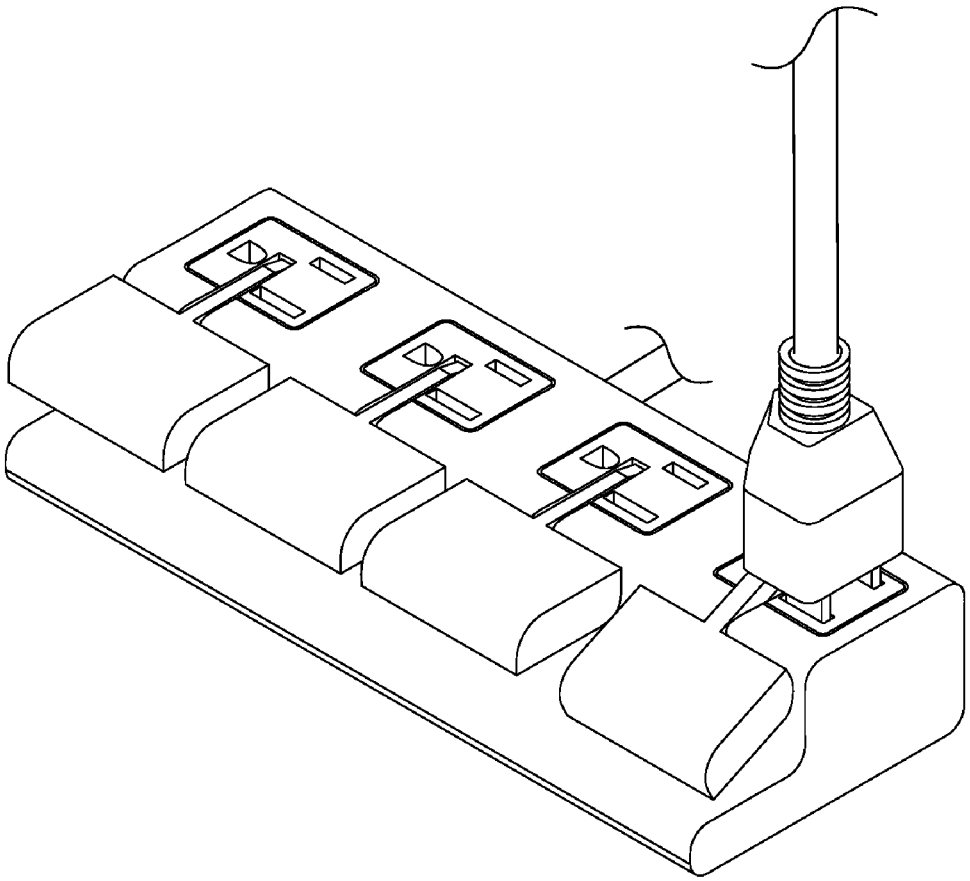
Figure No. 18

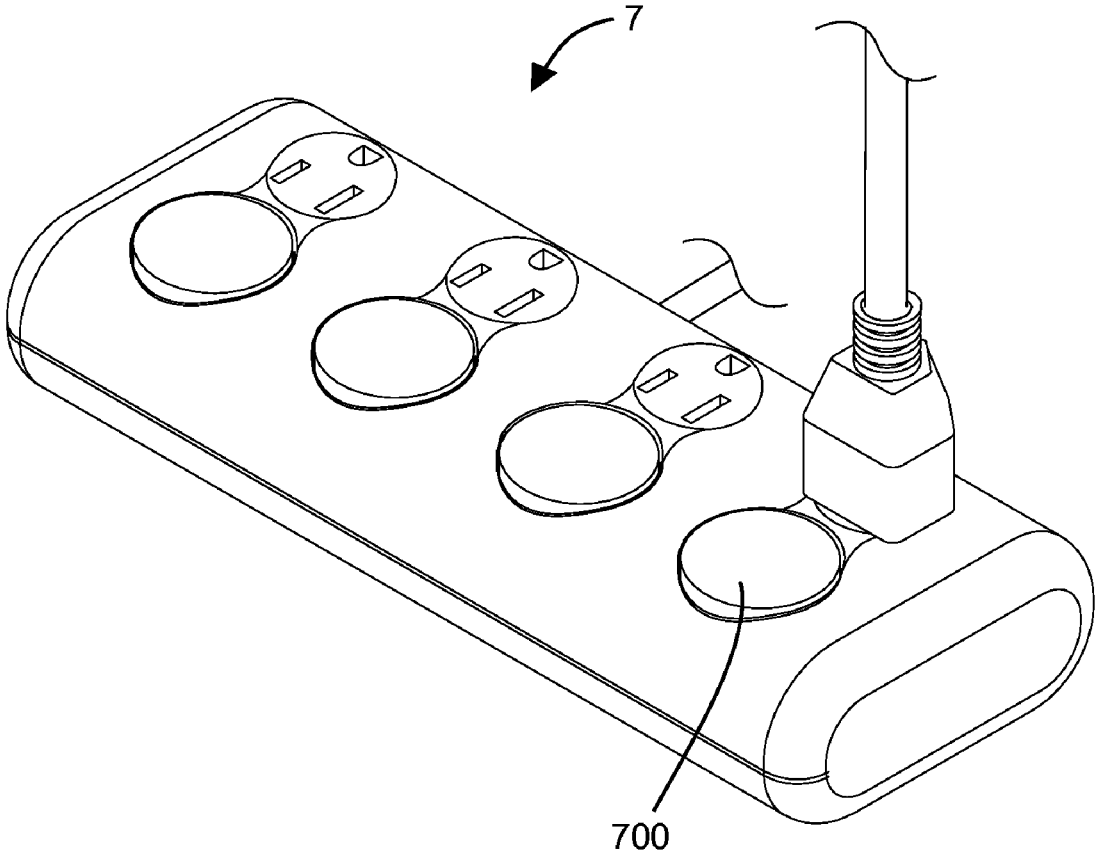
Figure No. 19

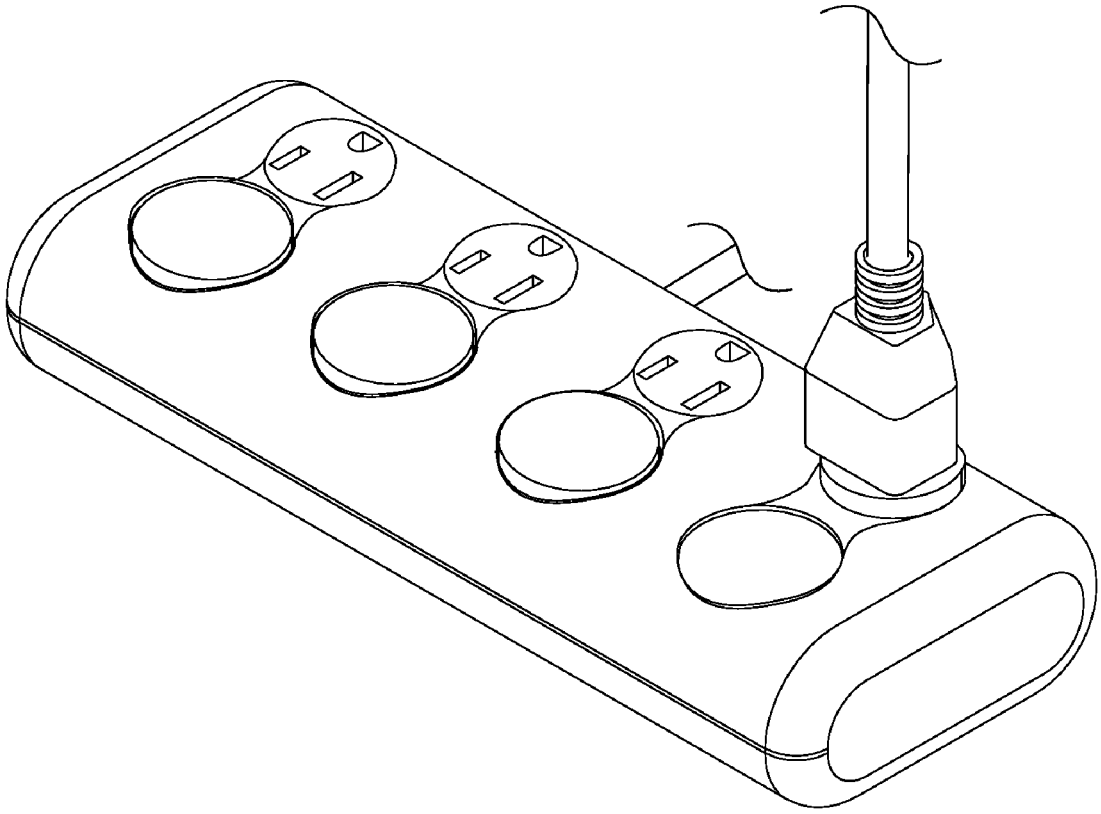
Figure No. 20

POWER CONNECTOR

CLAIM OF PRIORITY

This application claims the prior filing date of provisional application 61/141,719, filed on Dec. 31, 2008 the entirety of which is incorporated by reference herein.

BACKGROUND/FIELD

The present disclosure pertains at least to electrical connectors, namely to devices constituting an electricity conducting contact between conductors of electricity; wherein the joint is of a type which may be readily made and broken, repeatedly by attachment and detachment of contact supporting structure on each conductor.

Further, in some instances the present disclosure pertains to electrical connectors having at least one of the plural-contact coupling parts contained within the single unitary structure which comprises a receptacle adapted to be coupled to a complementary plug having extending therefrom at least two spaced, elongated, fingerlike counter-contacts whose longitudinal axes are parallel to the longitudinal axis along which the one coupling part is intended to be pushed toward and thereby into engagement with other, and wherein the receptacle has at least two correspondingly spaced contacts for slidingly engaging the elongated fingerlike counter-contacts along the longitudinal axes thereof whenever the one coupling part is longitudinally pushed into embracing relationship with the other.

SUMMARY

Within the scope of the present disclosure, a power connector includes at least a substantially hollow body; a an electrically conductive connector disposed on the surface of the body; wherein the connector is capable of receiving and retaining a plug therewithin and is configured to couple that plug to an electrical network; wherein each plug has at least one electrical conductor protruding from a plug face disposed at an end of a flexible electrical conductor; a lever pivotably coupled to the body with the lever being a member having at least a distal end portion, a proximal end portion, and a hinge disposed therebetween; wherein urging of the proximal end portion of the lever towards the body by a user results in the distal end portion of the lever abutting a portion of the plug urging said plug out of the connector and away from the body.

It is further contemplated that there are other embodiments of the present disclosure wherein a power connector has a plug that is an alternating current electrical connector selected from the following groups, the NEMA-specified non-locking alternating current connectors, the NEMA-specified locking alternating current connectors, the CEE specified alternating current connectors, the BS specified alternating current connectors, the SI specified alternating current connectors.

It is further contemplated that there are other embodiments of a power connector within the scope of the present disclosure wherein at least a portion of the lever is disposed within the body.

It is further contemplated that there are other embodiments of a power connector within the scope of the present disclosure wherein, upon depression, the distal end portion of the lever abuts a portion of the plug face.

It is further contemplated that there are other embodiments of a power connector within the scope of the present disclosure wherein there is a biasing member which urges the proximal end portion of the lever away from the body.

It is further contemplated that there are other embodiments of a power connector within the scope of the present disclosure wherein the distal end portion of the lever comprises the face of the connector disposed on the body, with traverse slits removed therefrom to allow the travel of the electrical conductor upon depression of the lever.

It is further contemplated that there are other embodiments of a power connector within the scope of the present disclosure wherein the distal end portion of the lever comprises a beam disposed between at least two electrical conductors.

It is further contemplated that there are other embodiments of a power connector within the scope of the present disclosure wherein the distal end portion of the lever comprises two beams disposed on opposing sides of at least two electrical conductors.

It is further contemplated that there are other embodiments of the present disclosure wherein a power connector wherein the proximal end portion of the lever comprises a substantially planar area configured to by actuated by a user's foot defining a pedal.

It is further contemplated that there are other embodiments of a power connector within the scope of the present disclosure wherein the body has a portion removed therefrom configured to allow sufficient travel of the proximal end portion of the lever upon insertion and removal of the plug.

It is further contemplated that there are other embodiments of a power connector within the scope of the present disclosure wherein the proximal end portion of the lever is disposed within the body and covered by a deformable seal, wherein the seal is disposed on the surface of the body.

It is further contemplated that there are other embodiments of a power connector within the scope of the present disclosure wherein each hinge is selected from the group of, a pin, a hole, a bearing surface, or a channel; and there is a corresponding structure disposed within the body.

It is further contemplated that there are other embodiments of a power connector within the scope of the present disclosure wherein there are a plurality of connectors.

It is further contemplated that there are other embodiments of a power connector within the scope of the present disclosure wherein there are a plurality of connectors disposed on opposing sides of the body.

It is further contemplated that there are other embodiments of a power connector within the scope of the present disclosure wherein the proximal end portion is substantially larger than the distal end portion providing a mechanical advantage of at least 15% compared to an equilateral arrangement.

BRIEF DESCRIPTION OF THE FIGURES

In the figures, which are not necessarily drawn to scale, like numerals describe substantially similar components throughout the several views. The drawings illustrate generally, by way of example, but not by way of limitation, various embodiments discussed in the claims of the present document.

FIG. 1 is a top view of an embodiment of the present disclosure in a first condition.

FIG. 2 is a back view of the embodiment of the present disclosure shown in FIG. 1.

FIG. 3 is a front view of the embodiment of the present disclosure shown in FIG. 1.

FIG. 4 is an isometric view of the embodiment of the present disclosure shown in FIG. 1.

FIG. 5 is an exploded view of the embodiment of the present disclosure shown in FIG. 1.

FIG. 6 is an isometric view of the embodiment of the present disclosure shown in FIG. 1 in a second condition.

FIG. 7 is an isometric view of the embodiment of the present disclosure shown in FIG. 1 in a third condition.

FIG. 8*a* is a section view taken through section A of an embodiment of the present disclosure in a first condition.

FIG. 8*b* is a section view taken through section A of an embodiment of the present disclosure in a second condition.

FIG. 8*c* is a section view taken through section A of an embodiment of the present disclosure in a third condition.

FIG. 9 is an isometric view of another embodiment of the present disclosure.

FIG. 10 is an isometric view of another embodiment of the present disclosure in a first condition.

FIG. 11 is an isometric view of the embodiment of the present disclosure shown in FIG. 10 in a second condition.

FIG. 12 is an exploded view of the embodiment of the present disclosure shown in FIG. 10.

FIG. 13 is an isometric view of another embodiment of the present disclosure in a first condition.

FIG. 14 is an isometric view of the embodiment of the present disclosure shown in FIG. 13 in a second condition.

FIG. 15 is an isometric view of another embodiment of the present disclosure in a first condition.

FIG. 16 is an isometric view of the embodiment of the present disclosure shown in FIG. 15 in a second condition.

FIG. 17 is an isometric view of another embodiment of the present disclosure in a first condition.

FIG. 18 is an isometric view of the embodiment of the present disclosure shown in FIG. 17 in a second condition.

FIG. 19 is an isometric view of another embodiment of the present disclosure in a first condition.

FIG. 20 is an isometric view of another embodiment of the present disclosure in a second condition.

DETAILED DESCRIPTION OF THE FIGURES

Within the scope of the present disclosure, the terms distal and proximal shall have their ordinary meaning in the art, namely that "distal" refers to the portion of a structure furthest from an operator and that "proximal" refers to the portion of a structure closest to an operator.

With reference to FIG. 1, a power connector 1 is shown including a body 50, a plurality of hinged pedals 100(*a-d*) disposed within and protruding from the body, and a plurality of corresponding power receptacles 150(*a-d*) disposed on the surface thereof. Power connector 1 further comprises at least one switch 60, a plurality of state indicators 70(*a-d*), and a cord 80.

With continued reference to FIG. 1, power receptacles 150(*a-d*), switch 60, indicators 70(*a-d*), and cord 80 are internally configured for coupling of devices to alternating current power networks and notifying users of varying states of the network with visual notification upon the indicators 70(*a-d*) or audible indications. Such configurations are well known in the art and disclosed at least in U.S. Pat. Nos. 4,705,342 and 4,867,701 which are incorporated by reference herein in their entirety. One of ordinary skill in the art will further appreciate that other devices such as surge suppressors, surge protections, and advanced or customizable switching topologies may be incorporated within the aforementioned network within the scope of the present disclosure and without undue experimentation.

One of ordinary skill in the art will also appreciate that power receptacles 150(*a-d*) and other power receptacles recited in the present disclosure are NEMA 5 compliant power connectors. That said, one of reasonable skill in the art will appreciate that the NEMA 5 compliant connectors shown in the figures could be replaced by other power connector standards used in the United States and abroad now and in the future including for instance any of the NEMA-specified non-locking alternating current connectors, the NEMA-specified locking alternating current connectors, the CEE specified alternating current connectors, the BS specified alternating current connectors, and the SI specified alternating current connectors while remaining within the scope of the present disclosure without undue experimentation.

With reference to FIG. 5, a pedal 100 is an elongated member having a distal end portion 120, a proximal end portion 130, and a hinging point 128 disposed therebetween. Further, there is a biasing member 140, and a pin 175 configured to hingedly couple pedal 100 to body 50.

With continued reference to FIG. 5, distal end portion 120 is a narrow elongated member configured to fit between the two conductors 155*a* and 155*b* of receptacle 150. Further, distal end portion 120 has a angled tip 125 at the distal-most point thereof. There is a hinge point 128 disposed upon the surface pedal 100 comprising a hole configured to rotatably retain pin 175 therein. Proximal end portion 130 is a substantially planar portion having grip 131 disposed on the top surface thereof. Grip 131 may be an elevated area composed of the same material as pedal 100 or composed of another material having a greater coefficient of static friction than the material of which pedal 100 is composed. There is a slope 132 disposed on the proximal-most portion of pedal 100.

With continued reference to FIG. 5, body 50 has a portion removed therefrom defining hollow 60. Hollow 60 has walls 61(*a*) and 61(*b*) and floor 62. Hollow 60 is configured to allow travel of proximal end portion 130 of pedals 100(*a-d*). There is a plurality of slits 70(*a-d*) removed from body 50 configured to allow movement of distal end portion 120 of pedals 100(*a-d*). There is a pin recess 81 disposed within slit 70(*a-d*) configured to retain pin 145.

Upon assembly, as shown in FIGS. 8(*a-c*), pedals 100(*a-d*) are disposed within slits 70(*a-d*) such that pin 145 extends through biasing member 140, hinging point 128, and into pin recess 81. In such a configuration, proximal end portion 130 extends over hollow 60. One of ordinary skill in the art will appreciate that the pin structure described in this paragraph may optionally be incorporated into a pedal.

With reference to FIG. 8*a*, upon assembly, biasing member 140 exerts a biasing force upon a spring portion 151 disposed on body 50 and stepped shoulder 110 disposed on pedal 100(*a-d*). The aforementioned biasing force urges pedal 100 (*a-d*) to rotate about hinging point 128 such that the distal-most portion of stepped shoulder 110 abuts a pedal stop 152 disposed on 50.

As shown in FIG. 8*c*, when a sufficient downward force F is applied to proximal end portion 130 of pedal 100(*a-d*) relative to body 50 to overcome the force of biasing member 140(*a-d*), proximal end portion 130 pivots about pin 81(*a-d*), until the proximal-most portion of stepped shoulder 110 abuts floor 62 thereby compressing biasing member 140(*a-d*) and separating distal end portion 125 from the surface of body 50. When force F is removed from proximal end portion 130 of pedal 100(*a-d*), biasing member 140 urges proximal end portion 130 away from body 50 thereby returning the device to the first state, as shown in FIG. 8*a*.

A further embodiment of the present disclosure is shown in FIG. 9, wherein a power connector 2 has a power receptacle 250*g* without a pedal associated therewith.

With reference to FIG. 10, another embodiment of the present disclosure is shown wherein a power connector 3 includes a body 350, handle 325, and power receptacles 351 (*a-d*) disposed on the surface of body 350, whereby upon assembly a substantial portion of the exposed surface of receptacles 351(*a-d*) is obscured by a portion of levers 375 (*a-d*).

With reference to FIG. 12, an exploded view is provided of power connector 3. Pedal 375 is an elongated member having a distal end portion 377 having slits 378(*a-c*) removed from the surface thereof to allow the travel of conductors disposed on a plug (not shown). Pedal 375 has a proximal end portion 379 configured to be actuated by the foot or hand of a user. There is an angle x between the surfaces of proximal end portion 379 and distal end portion 377. There is a skirt 380 disposed about the periphery of pedal 375 having a hole 381 removed therefrom and configured to pivotably retain pin 390 therein. There is a lever groove 352(*a-d*) disposed between receptacle 351(*a-b*) and the surface of body 350 within which skirt 380 of pedal 375 can travel upon rotation about pin 390(*a-d*). Further, there is a surface 382 of receptacle 352 which alternatively provides stops for distal end portion 377 or proximal end portion 379 as lever 357(*a-d*) is rotated about pin 390(*a-d*). Optionally, there may be a biasing member disposed within body 350 which urges distal end portion 377 against the surface of receptacles 351(*a-d*).

With reference to FIG. 13, an embodiment of the present disclosure is shown wherein a power connector 4 comprises two opposing banks of receptacles and corresponding pedals.

With reference to FIG. 15, an embodiment of the present disclosure is shown wherein a power connector 5 comprises a pair of levers 500(*a* and *b*) disposed on opposing sides of conductors 511(*a* and *b*) of a receptacle 510.

With reference to FIG. 17, an embodiment of the present disclosure is shown wherein a power connector 6 comprises at least one pedal having a distal end portion 610 configured to be disposed between a ground connector 615 and hot connectors 620(*a* and *b*) of a receptacle 630.

With reference to FIG. 19, an embodiment of the present disclosure is shown wherein a power connector 7 has all or a portion of the proximal end portion of a pedal as recited in the preceding embodiments disposed behind a deformable seal 700.

Although the embodiments shown in the figures show receptacles in linear and planar configurations, there are embodiments within the scope of the present disclosure which are neither linear or planar, including for instance receptacles arranged about a cone, circle, or other shape known in the art.

A method of using the several embodiments of the present disclosure will now be described with reference to FIGS. 8*a*-8*c*. Although the method that follows will be described with particular reference to the embodiment shown in FIGS. 8*a*-8*c*, one of reasonable skill in the art will appreciate that the following method can be readily modified for use with the remaining embodiments.

A power connector 1 is provided in a first state, as shown in FIG. 8*a* wherein a biasing member 150 urges the distal end portion 120 of a pedal 100 into a substantially coplanar relation with the surface 51 of a receptacle 150. In a second state, shown in FIG. 8*b*, A cord 200 having at least one electrical conductor 210 extending from a plug surface 220 may be inserted by a user into receptacle 150 establishing electrical coupling therewith. In a third state, shown in FIG. 8*c*, sufficient downward force F has been applied to proximal end portion 130 of pedal 100 to overcome the force of biasing member 150 thereby separating distal end portion 120 of pedal 100 from body 50 and consequently urging plug 200 upward and out of the receptacle.

One of ordinary skill in the art will appreciate that several of the embodiments herein include a device for the ejection of a power connector from a receptacle having either a mechanical advantage for the achieving the same, a lever system for achieving the same, or both.

In the preceding description, any coupling of two members (excluding those couplings which are described as movable) may occur through the use appropriate coupling methods known in the art, including, but not limited to press-fitting, snap fitting, clips, adhesives, welding, chemical welding, sonic welding, screws, or clevises.

In the preceding description, any movable coupling of two members may occur through the use of appropriate joints known in the art, including, but not limited to pins, hinges, clips, clevises, or bearing surfaces.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. An improved connector group comprising;

a substantially enclosed volume thereby defining a body;

an electrically conductive connector disposed on the surface of the body;

wherein the connector is capable of receiving and retaining a plug therewithin and is configured to couple that plug to an electrical network;

wherein each plug has at least one electrical conductor protruding from a plug face disposed at an end of a flexible electrical conductor;

a lever pivotably coupled to the body with the lever being a member having at least a distal end portion, a proximal end portion, and a hinge disposed therebetween, wherein at least a portion of the lever is disposed within the body and the distal end portion of the lever is substantially flush with the face of the connector disposed on the body and the proximal end portion of the lever protrudes from the space defined by the body;

wherein urging of the proximal end portion of the lever towards the body by a user results in the distal end portion of the lever abutting a portion of the plug urging said plug out of the connector and away from the body.

2. The connector group of claim 1, wherein at the plug is an alternating current electrical connector selected from the following groups, the NEMA-specified non-locking alternating current connectors, the NEMA-specified locking alternating current connectors, the CEE specified alternating current connectors, the BS specified alternating current connectors, the SI specified alternating current connectors.

3. The connector group of claim 1, wherein upon depression, the distal end portion of the lever abuts a portion of the plug face.

4. The connector group of claim 1, wherein there is a biasing member which urges the proximal end portion of the lever away from the body.

5. The connector group of claim 1, wherein the distal end portion of the lever comprises the face of the connector disposed on the body, with traverse slits removed therefrom to allow the travel of the electrical conductor upon depression of the lever.

6. The connector group of claim 1, wherein the distal end portion of the lever comprises a beam disposed between at least two electrical conductors.

7. The connector group of claim 1, wherein the distal end portion of the lever comprises two beams disposed on opposing sides of at least two electrical conductors.

8. The connector group of claim 1, wherein the proximal end portion of the lever comprises a substantially planar area sized and shaped to by actuated by a user's foot defining a pedal.

9. The connector group of claim 1, wherein the body has a portion removed therefrom sized and shaped to allow sufficient travel of the proximal end portion of the lever upon insertion and removal of the plug.

10. The connector group of claim 1, wherein the proximal end portion of the lever is disposed within the body and covered by a deformable seal, wherein the seal is disposed on the surface of the body.

11. The connector group of claim 1, wherein each hinge is selected from the group of, a pin, a hole, a bearing surface, or a channel; and there is a corresponding structure disposed within the body.

12. The connector group of claim 1, wherein there are a plurality of connectors.

13. The connector group of claim 1, wherein there are a plurality of connectors disposed on opposing sides of the body.

14. The connector group of claim 1, wherein the proximal end portion is substantially larger than the distal end portion providing a mechanical advantage of at least 15% compared to an equilateral arrangement.

15. A improved connector group comprising;

a substantially enclosed volume thereby defining a body;

an electrically conductive connector disposed on the surface of the body;

wherein the connector is capable of receiving and retaining a plug therewithin and is configured to couple that plug to an electrical network;

wherein each plug has at least one electrical conductor protruding from a plug face disposed at an end of a flexible electrical conductor;

a lever pivotably coupled to the body with the lever being a member having at least a distal end portion, a proximal end portion, and a hinge disposed therebetween, wherein at least a portion of the lever is disposed within the body and the distal end portion of the lever is substantially flush with the face of the connector disposed on the body and the proximal end portion of the lever protrudes from the space defined by the body;

wherein urging of the proximal end portion of the lever towards the body by a user results in the distal end portion of the lever abutting a portion of the plug urging said plug out of the connector and away from the body and the body has a portion removed therefrom sized and shaped to allow sufficient travel of the proximal end portion of the lever upon insertion and removal of the plug.

16. A improved connector group comprising;

a substantially enclosed volume thereby defining a body;

an electrically conductive connector disposed on the surface of the body;

wherein the connector is capable of receiving and retaining a plug therewithin and is configured to couple that plug to an electrical network;

wherein each plug has at least one electrical conductor protruding from a plug face disposed at an end of a flexible electrical conductor; a lever pivotably coupled to the body with the lever being a member having at least a distal end portion, a proximal end portion, and a hinge disposed therebetween, wherein at least a portion of the lever is disposed within the body and the distal end portion of the lever is substantially flush with the face of the connector disposed on the body and the proximal end portion of the lever protrudes from the space defined by the body; wherein urging of the proximal end portion of the lever towards the body by a user results in the distal end portion of the lever abutting a portion of the plug urging said plug out of the connector and away from the body and the proximal end portion of the lever comprises a substantially planar area sized and shaped to by actuated by a user's foot defining a pedal.

* * * * *